US011688933B2

(12) United States Patent
Choi

(10) Patent No.: US 11,688,933 B2
(45) Date of Patent: Jun. 27, 2023

(54) VEHICULAR ANTENNA DEVICE

(71) Applicant: LS MTRON LTD., Anyang-si (KR)

(72) Inventor: Seung-Ho Choi, Anyang-si (KR)

(73) Assignee: LS MTRON LTD., Anyang-si (KR)

( * ) Notice: Subject to any disclaimer, the term of this patent is extended or adjusted under 35 U.S.C. 154(b) by 882 days.

(21) Appl. No.: 16/606,498

(22) PCT Filed: Apr. 26, 2018

(86) PCT No.: PCT/KR2018/004859

§ 371 (c)(1),
(2) Date: Oct. 18, 2019

(87) PCT Pub. No.: WO2018/199651

PCT Pub. Date: Nov. 1, 2018

(65) Prior Publication Data

US 2020/0194877 A1 Jun. 18, 2020

(30) Foreign Application Priority Data

Apr. 28, 2017 (KR) ..... 10-2017-0055432
Apr. 20, 2018 (KR) ..... 10-2018-0046168

(51) Int. Cl.
*H01Q 1/32* (2006.01)
*H01Q 1/42* (2006.01)
(Continued)

(52) U.S. Cl.
CPC ..... *H01Q 1/3275* (2013.01); *H01Q 1/42* (2013.01); *H01Q 15/14* (2013.01); *H01Q 1/12* (2013.01)

(58) Field of Classification Search
CPC ..... H01Q 1/42; H01Q 1/3275; H01Q 1/12; H01Q 15/14; H01Q 19/102; H01Q 19/17; H01Q 21/00
See application file for complete search history.

(56) References Cited

U.S. PATENT DOCUMENTS 2,599,705 A 6/1952 Erwin
4,672,387 A 6/1987 Waddoup et al.
(Continued)

FOREIGN PATENT DOCUMENTS

FR 2334216 A1 7/1977
FR 2334216 A1 7/1997
(Continued)

OTHER PUBLICATIONS

International Search Report for related International Application No. PCT/KR2018/004859; report dated Nov. 1, 2018; (3 Pages).
(Continued)

*Primary Examiner* — Awat M Salih
(74) *Attorney, Agent, or Firm* — K&L Gates LLP

(57) ABSTRACT

A vehicular antenna device comprises: a directional antenna having a plurality of unit antenna elements arranged in a predetermined direction and thereby having upward directionality; and a radio wave diffusion structure installed vertically above the directional antenna so as to reflect radiated radio waves, which are radiated upward from the directional antenna, in the lateral direction such that the same are diffused omnidirectionally. The vehicular antenna device is applicable to 5G mobile communication, the same has omnidirectionality that a vehicular antenna is required to have, and the antenna structure can be made compact and simple.

5 Claims, 11 Drawing Sheets

(51) Int. Cl.
*H01Q 15/14* (2006.01)
*H01Q 1/12* (2006.01)

(56) References Cited

U.S. PATENT DOCUMENTS

| | | | | |
|---|---|---|---|---|
| 6,084,552 | A * | 7/2000 | Robertson | H01Q 19/10 343/756 |
| 6,219,004 | B1 | 4/2001 | Johnson | |
| 7,940,225 | B1 * | 5/2011 | Ball | H01Q 19/09 343/773 |
| 10,199,746 | B2 * | 2/2019 | Kim | H01Q 1/3233 |
| 2003/0122719 | A1 * | 7/2003 | Nilsson | H01Q 9/44 343/711 |
| 2010/0220024 | A1 * | 9/2010 | Snow | H01Q 9/28 343/753 |
| 2014/0118220 | A1 | 5/2014 | Ley | |
| 2015/0015453 | A1 * | 1/2015 | Puzella | H05K 1/0206 333/1.1 |
| 2017/0110790 | A1 | 4/2017 | Kim | |

FOREIGN PATENT DOCUMENTS

| | | | |
|---|---|---|---|
| GB | 2155245 | A | 9/1985 |
| JP | S 63-131602 | A | 6/1988 |
| JP | 05-114816 | A | 5/1993 |
| JP | H11-289218 | A | 10/1999 |
| JP | 2000-353914 | A | 12/2000 |
| JP | 2005-175557 | A | 6/2005 |
| JP | 2009-135741 | A | 6/2009 |
| JP | 2011-015203 | A | 1/2011 |
| JP | 20110160339 | A | 8/2011 |
| JP | 2015-159354 | A | 9/2015 |
| KR | 100835897 | B1 | 6/2008 |
| KR | 1020120107664 | A | 10/2012 |
| KR | 1020150090077 | A | 8/2015 |
| KR | 1020170044504 | A | 4/2017 |
| WO | 9729525 | A1 | 8/1997 |

OTHER PUBLICATIONS

Written Opinion for related International Application No. PCT/KR2018/004859; report dated Nov. 1, 2019; (4 Pages).

* cited by examiner

VEHICULAR ANTENNA DEVICE

CROSS REFERENCE TO RELATED APPLICATIONS

The present application is a National Stage of International Application No. PCT/KR2018/004859 filed on Apr. 26, 2018, which claims the benefit of Korean Patent Application No. 10-2017-0055432 filed on Apr. 28, 2017 and Korean Patent Application No. 10-2018-0046168 filed on Apr. 20, 2018 with the Korean Intellectual Property Office, the entire contents of each hereby incorporated by reference.

FIELD OF TECHNOLOGY

The present disclosure relates to a vehicular antenna device, and more particularly, to an omnidirectional vehicular antenna device that is applicable to 5G mobile communication.

BACKGROUND

In general, a vehicular antenna refers to various types of antennas mounted inside or outside of a vehicle for communication of wireless communication devices used in the vehicle. Recently, as the traffic of the existing mobile communication infrastructure reaches the limit, 5th generation mobile communications (5G) technology has been suggested, and there is a dramatic increase in interest and study of vehicular antenna technology that can be applied to 5G mobile communication.

However, as disclosed by Korean Patent Publication No. 10-2012-0107664, the existing technologies using a so-called helical antenna have low radiation efficiency, namely, a ratio of radiated power to input power, due to the narrow transmission and reception area, and especially, it is difficult to apply to 5G mobile communication for transmitting and receiving ultra high frequency band signals of 28 GHz or more.

Additionally, the existing directional antenna (array antenna) allows the transmission and reception of high frequency band signals and predetermined range beam tracking, but cannot ensure the omnidirectionality required for a vehicular antenna because it basically has high directionality.

The present disclosure is directed to providing a vehicular antenna device that is applicable to 5G mobile communication, and has the omnidirectionality required for a vehicular antenna as well as a compact and simple antenna structure.

SUMMARY

A vehicular antenna device according to an embodiment of the present disclosure includes a directional antenna which radiates radio waves in a predetermined direction, and a radio wave diffusion structure installed vertically above the directional antenna to reflect the radio waves radiated upwards from the directional antenna in a lateral direction for omnidirectional spreading.

In an embodiment, the directional antenna may be an array antenna having an upward directionality, the array antenna including a plurality of unit antenna elements arranged upwards.

In an embodiment, the radio wave diffusion structure may have a reciprocal cone shape with a base facing upwards and an apex facing the directional antenna.

In an embodiment, the radio wave diffusion structure may have an inwardly curved lateral surface in vertical cross section.

In an embodiment, a lateral surface of the radio wave diffusion structure is inwardly curved at a constant radius of curvature R in vertical cross section, and a magnitude of the radius of curvature R satisfies the following Equation 1 when a magnitude of wavelength of the radiated radio waves is λ:

$$\pi\lambda<R<20\lambda \quad \text{[Equation 1]}$$

In an embodiment, a vertical direction distance h between the apex of the radio wave diffusion structure and the directional antenna satisfies the following Equation 2, when a magnitude of wavelength of the radiated radio waves is λ:

$$0<h\leq 2\lambda \quad \text{[Equation 2]}$$

In an embodiment, the device may further include a dome structure which covers a space above the directional antenna, and in which the radio wave diffusion structure is installed on an inner surface.

In an embodiment, the device may further include a base plate which is coupled to a lower surface of the directional antenna to support the directional antenna.

In an embodiment, the base plate may be coupled to a lower edge of the dome structure and configured to support the dome structure.

In an embodiment, the base plate may include a coupling part which is coupled with a roof outer panel of a vehicle.

According to the present disclosure, the omnidirectional vehicular antenna is implemented using the directional antenna capable of transmitting and receiving ultra high frequency band signals of 28 GHz or more, thereby applying 5G mobile communication technology to vehicular communication and improving the speed and quality of vehicular communication.

Additionally, without using a component for beam tracking, the radio wave diffusion structure is installed vertically above the directional antenna having high directionality to omnidirectionally spread out the radio waves radiated from the directional antenna traveling vertically upwards, making it possible to reduce the size of a vehicular antenna and simplify the entire architecture of a vehicular communication system while ensuring the omnidirectionality required for a vehicular antenna.

Additionally, the vehicular antenna device is formed in a dome shape and installed in the roof outer panel of the vehicle, thereby preventing damage of the directional antenna and ensuring the antenna performance.

Further, those having ordinary skill in the technical field pertaining to the present disclosure will obviously understand from the following description that many embodiments according to the present disclosure can solve many technical problems not mentioned herein.

DETAILED DESCRIPTION

Hereinafter, to clarify the solution to the technical problem of the present disclosure, the embodiments of the present disclosure will be described in detail with reference to the accompanying drawings. However, in describing the present disclosure, a certain detailed description of known technology rather renders the key subject matter of the present disclosure ambiguous, the description is omitted herein. In addition, the terms as used herein are defined taking into account the functions in the present disclosure and may be changed depending on the intent of the designer or manufacturer or the convention. Accordingly, the definition should be made based on the context throughout the specification.

Figure 1:
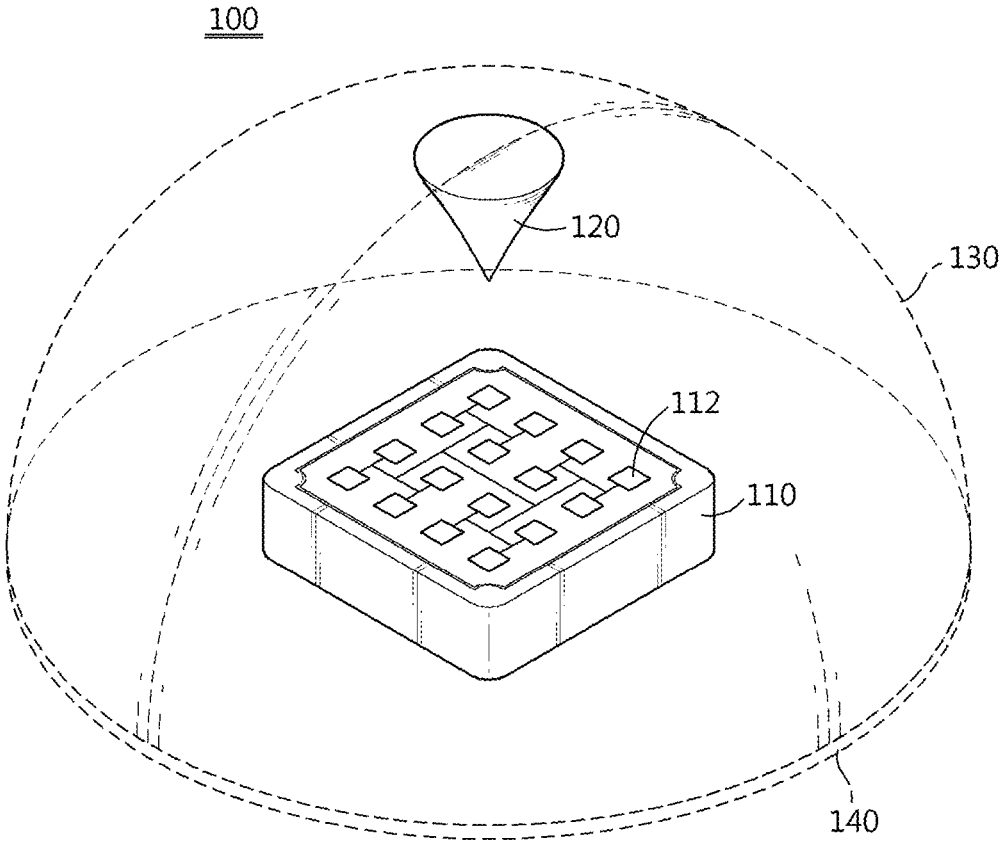
FIG. 1 is a perspective view showing a vehicular antenna device according to an embodiment of the present disclosure.

FIG. 1 is a perspective view showing a vehicular antenna device 100 according to an embodiment of the present disclosure.

Figure 2:
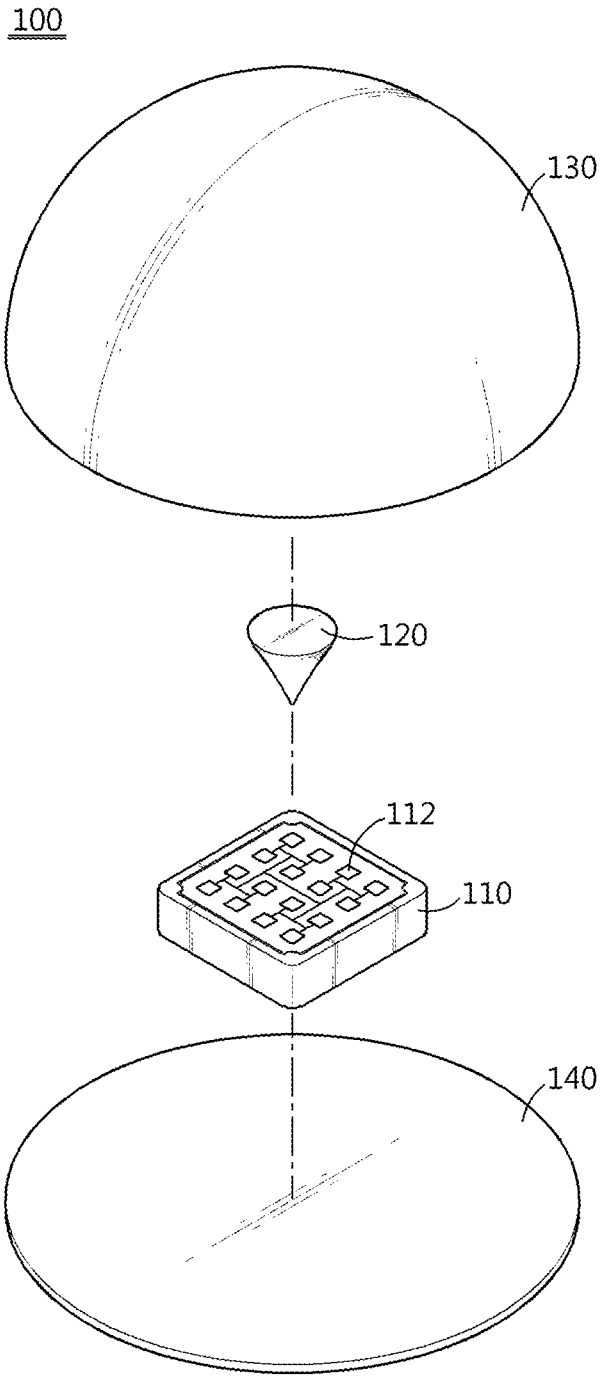
FIG. 2 is an exploded perspective view showing the vehicular antenna device shown in FIG. 1.

FIG. 2 is an exploded perspective view showing the vehicular antenna device 100 shown in FIG. 1.

As shown in FIGS. 1 and 2, the vehicular antenna device 100 according to an embodiment of the present disclosure may include a directional antenna 110 and a radio wave diffusion structure 120, and according to an embodiment, the vehicular antenna device 100 may further include a dome structure 130 and a base plate 140.

The directional antenna 110 is an antenna that radiates radio waves in a predetermined direction. The directional antenna 110 shown in FIG. 1 is an antenna having upward directionality to radiate radio waves vertically upwards. In an embodiment, the directional antenna 110 may be an array antenna having upward directionality, including a plurality of unit antenna elements 112 arranged facing upwards. In this case, each of the plurality of unit antenna elements 112 may be designed as a small antenna patch to transmit and receive ultra high frequency band signals of 28 GHz or more, and may be arranged in a matrix structure on a dielectric block. Additionally, each of the plurality of unit antenna elements 112 may be electrically connected to a feed circuit through a conductive pattern. The directional antenna 110 may be designed to have vertical upward directionality by the array orientation of each unit antenna element 112 and phase tuning of excitation current. According to an embodiment, in addition to the above-described array antenna, the directional antenna 110 may include various types of antennas having directionality of radiated radio waves.

The radio wave diffusion structure 120 may be installed vertically above the directional antenna 110 to reflect the radio waves radiated upwards from the directional antenna 110 in the lateral direction for omnidirectional spreading.

Figure 3:
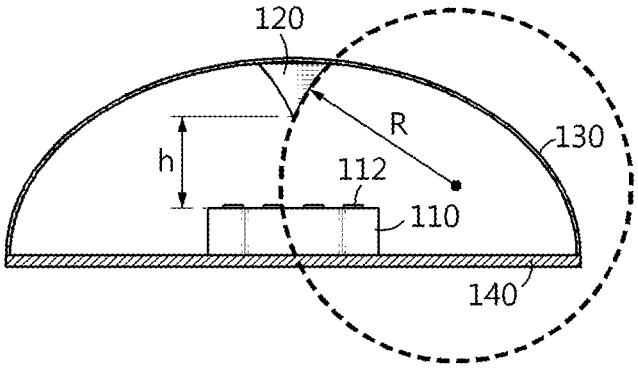
FIG. 3 is a vertical cross-sectional view showing the vehicular antenna device shown in FIG. 1.

FIG. 3 is a vertical cross-sectional view showing the vehicular antenna device 100 shown in FIG. 1.

As shown in FIG. 3, the radio wave diffusion structure 120 may be installed vertically above the directional antenna 110 by being coupled to the inner surface of the dome structure 130 covering a space above the directional antenna 110. Additionally, the radio wave diffusion structure 120 may have a reciprocal cone shape with the base facing upwards and the apex facing the directional antenna 110.

Figure 4:
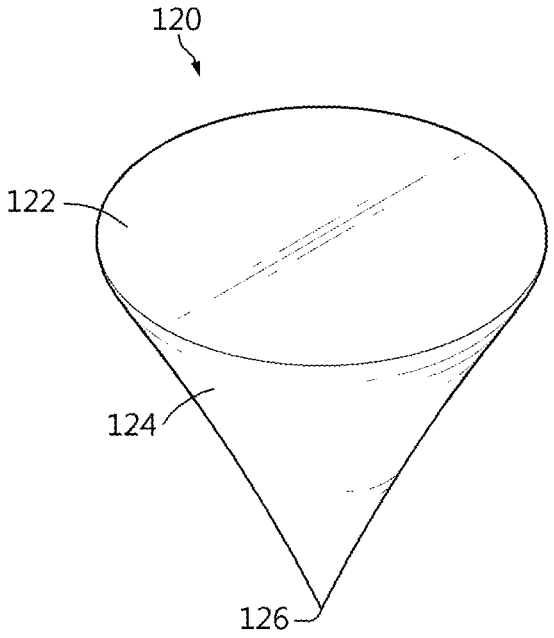
FIG. 4 is a perspective view showing an example of a radio wave diffusion structure applied to the present disclosure.

FIG. 4 is a perspective view showing an example of the radio wave diffusion structure 120.

As shown in FIG. 4, the radio wave diffusion structure 120 is formed in a reciprocal cone shape with the base 122 facing upwards and the apex 126 facing the directional antenna 110, to reflect the radio waves radiated vertically upwards from the directional antenna 110 in the lateral direction for omnidirectional spreading.

In this case, the radio wave diffusion structure 120 may have an inwardly curved lateral surface 124 in vertical cross section. The radio waves radiated from each antenna element 112 of the directional antenna 110 behave more like waves while rays behave more like particles, and the direction they travel may be determined by various factors such as the position of each antenna element 112 or the distance from an adjacent antenna element 112, a potential difference, interference between radio waves and the patch shape. As a result, the radio wave diffusion structure 120 having the lateral surface 124 of an inwardly curved shape with a constant curvature or different curvatures depending on position can realize the omnidirectionality required for the vehicular antenna device 100 more easily than the radio wave diffusion structure 120 having a perfectly reciprocal cone shape in vertical cross section such as a general reciprocal cone shape.

Figure 5:
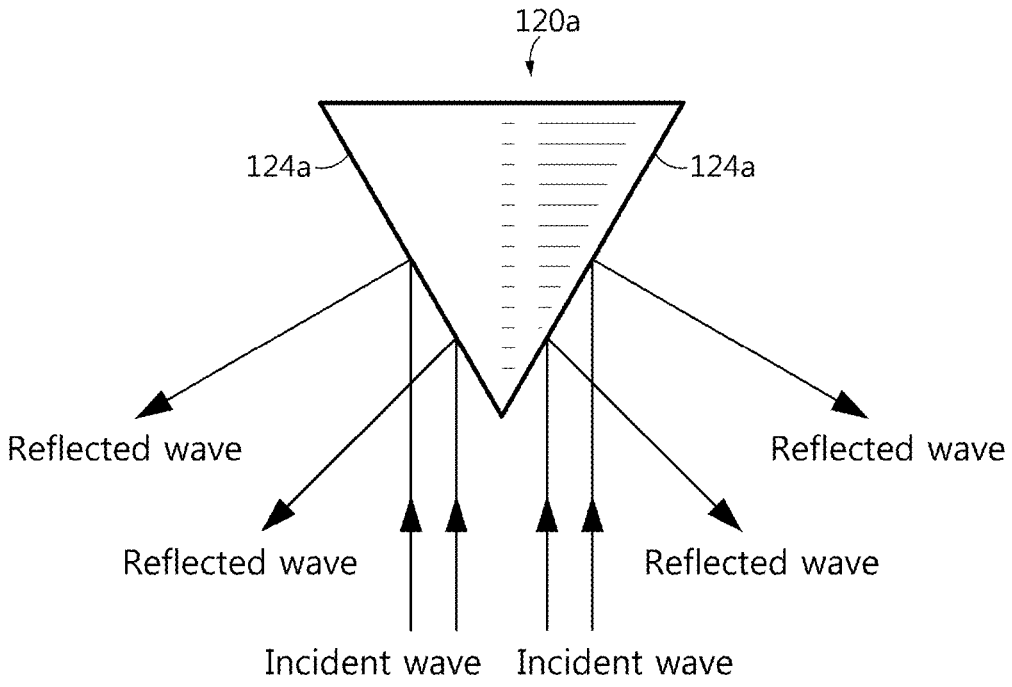
FIG. 5 is a diagram showing the radio wave reflection direction by a radio wave diffusion structure having a flat lateral surface in vertical cross section.

FIG. 5 shows the radio wave reflection direction by a radio wave diffusion structure 120*a* having a flat lateral surface 124*a* in vertical cross section.

As shown in FIG. 5, when the radio wave diffusion structure 120*a* having the flat lateral surface 124*a* in vertical cross section is applied to the present disclosure, radio waves (incident waves) radiated vertically upwards from the directional antenna 110 are reflected by the radio wave diffusion structure 120*a*, but all the reflected radio waves do not travel parallel to the ground and they travel downwards at a predetermined angle relative to the ground. The reason is because, as mentioned previously, radio waves radiated from each antenna element 112 of the directional antenna 110 behave more like waves while rays behave more like particles, and the direction they travel is determined by various factors such as the position of each antenna element 112 or the distance from an adjacent antenna element 112, a potential difference and interference between radio waves. That is, when the radio wave diffusion structure 120*a* having the flat lateral surface 124*a* in vertical cross section is applied to the present disclosure, it is difficult to achieve the omnidirectionality of the radiation pattern required for a vehicle antenna.

Figure 6:
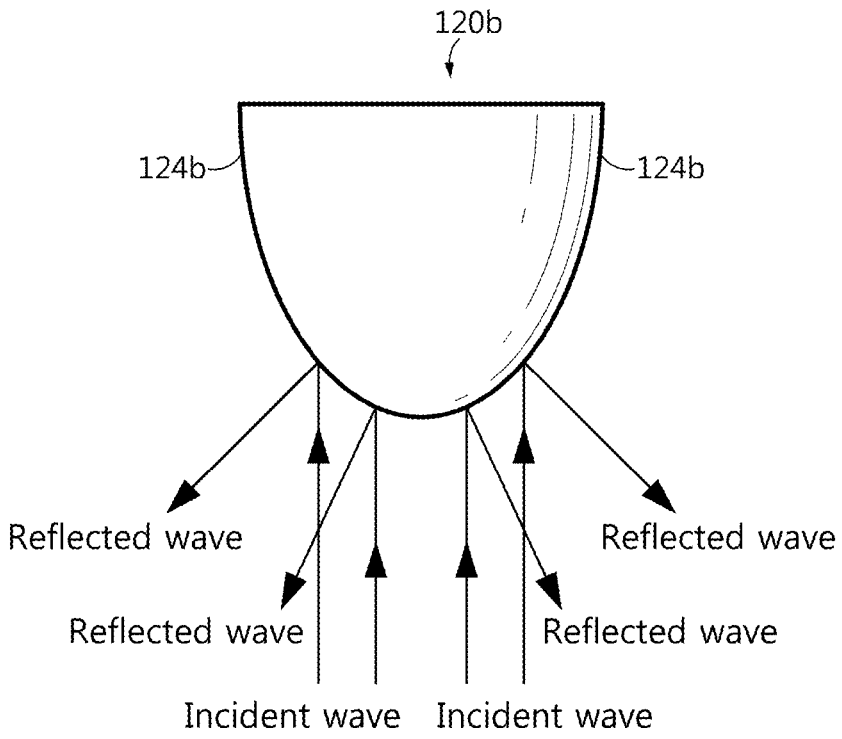
FIG. 6 is a diagram showing the radio wave reflection direction by a radio wave diffusion structure having an outwardly curved lateral surface in vertical cross section.

FIG. 6 is a diagram showing the radio wave reflection direction by a radio wave diffusion structure 120*b* having an outwardly curved lateral surface 124*b* in vertical cross section.

As shown in FIG. 6, when the radio wave diffusion structure 120*b* having the outwardly curved (convex) lateral surface 124*b* in vertical cross section is applied to the present disclosure, radio waves (incident waves) radiated vertically upwards from the directional antenna 110 are reflected by the radio wave diffusion structure 120*b*, but all the reflected radio waves do not travel parallel to the ground, and they travel downwards at an angle relative to the ground that is steeper than that of FIG. 5. That is, when the radio wave diffusion structure 120*b* having the outwardly curved lateral surface 124*b* in vertical cross section is applied to the present disclosure, it is impossible to achieve the omnidirectionality of the radiation pattern required for a vehicular antenna.

Figure 7:
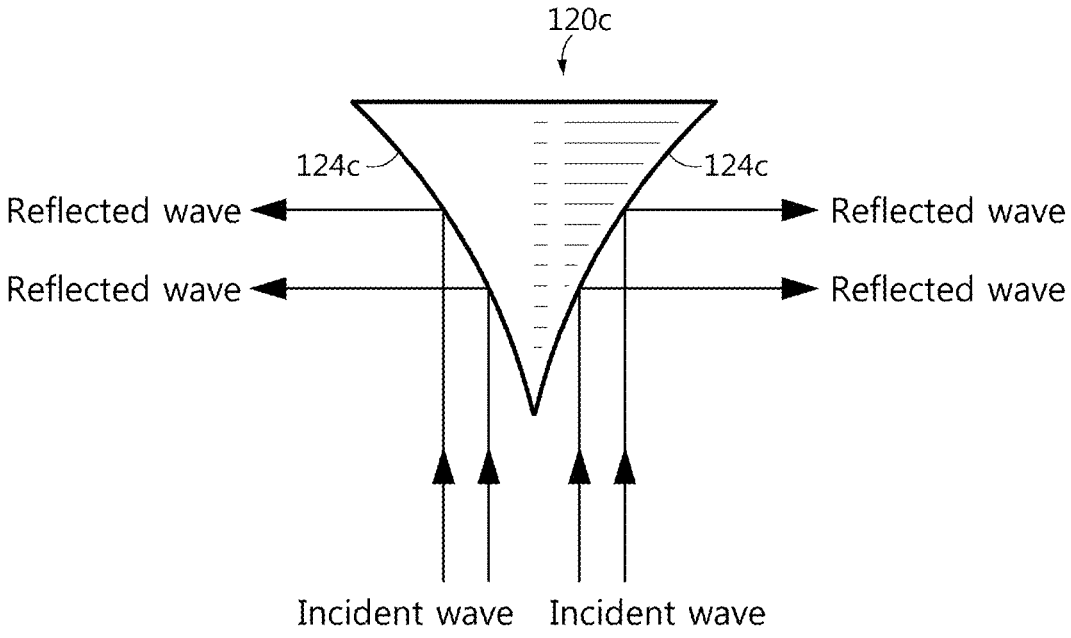
FIG. 7 is a diagram showing the radio wave reflection direction by a radio wave diffusion structure having an inwardly curved lateral surface in vertical cross section.

FIG. 7 is a diagram showing the radio wave reflection direction by a radio wave diffusion structure 120*c* having an inwardly curved lateral surface 124*c* in vertical cross section.

As shown in FIG. 7, when the radio wave diffusion structure 120*b* having the inwardly curved (concave) lateral surface 124*c* in vertical cross section is applied to the present disclosure, radio waves (incident wave) radiated vertically upwards from the directional antenna 110 are reflected by the radio wave diffusion structure 120*c*, and all the reflected radio waves travel parallel to the ground. That is, when the radio wave diffusion structure 120*c* having the inwardly curved lateral surface 124*c* in vertical cross section is applied to the present disclosure, it is possible to easily achieve the omnidirectionality of the radiation pattern required for a vehicular antenna.

Meanwhile, when manufacturing the radio wave diffusion structure 120, it is possible to achieve a desired reflection angle of radiated radio waves by adjusting the lateral surface angle and the lateral radius of curvature of the radio wave diffusion structure 120. In this case, the radio wave diffusion structure 120 may have the lateral surface 124 made of metal, at least corresponding to a reflecting surface.

Referring back to FIG. 3, as described above, the lateral surface of the radio wave diffusion structure 120 may be inwardly curved at a constant radius of curvature R in vertical cross section. Additionally, the radio wave diffusion structure 120 may be installed vertically above the center of the directional antenna 110 at a predetermined distance h from the directional antenna 110.

In this case, the magnitude of the radius of curvature R satisfies the following Equation 1, when the magnitude of wavelength of the radio waves radiated from the directional antenna 110 is λ.

$$\pi\lambda < R < 20\lambda \qquad \text{[Equation 1]}$$

Here, π denotes the ratio of a circle's circumference to its diameter.

When the lateral radius of curvature R of the radio wave diffusion structure 120 is equal to or less than πλ or equal to or more than 20λ, the radio waves radiated upwards from the directional antenna 110 do not spread well in the lateral direction, resulting in failure to ensure the omnidirectionality required for a vehicular antenna and a sharp reduction in antenna performance. That is, when the lateral radius of curvature R of the radio wave diffusion structure 120 is equal to or less than πλ, the lateral surface of the radio wave diffusion structure 120 is a substantially convex surface, and when the lateral radius of curvature R of the radio wave diffusion structure 120 is equal to or more than 20λ, similar to FIG. 5, the lateral surface of the radio wave diffusion structure 120 is a substantially flat surface, and thus, it is impossible to reflect the radio waves radiated from the directional antenna 110 in the lateral direction parallel to the ground. As a result, it is impossible to achieve the omnidirectionality of the radiation pattern required for a vehicular antenna.

Additionally, the shortest distance between the radio wave diffusion structure 120 and the directional antenna 110, i.e., the vertical direction distance h between the apex of the radio wave diffusion structure 120 and the directional antenna 110 satisfies the following Equation 2, when the magnitude of wavelength of the radio waves radiated from the directional antenna 110 is λ.

$$0 < h \leq 2\lambda \qquad \text{[Equation 2]}$$

When the vertical direction distance h between the apex of the radio wave diffusion structure 120 and the directional antenna 110 is greater than 2λ, the radio wave diffusion structure 120 does not work as a reflector, and rather works as a director due to the distance from the source important to the antenna, and as a result, radio waves are only radiated from the directional antenna 110 in the vertical direction, not in the lateral direction. That is, the radio wave diffusion structure 120 cannot reflect the radio waves radiated from the directional antenna 110 in the lateral direction parallel to the ground as shown in FIG. 7, failing to achieve the omnidirectionality of the radiation pattern required for a vehicular antenna.

Meanwhile, when the directional antenna 110 is formed in a square panel shape, the vertical direction distance h between the apex of the radio wave diffusion structure 120 and the directional antenna 110 may be calculated as shown in the following Equation 3.

$$h = \frac{3d + \sqrt{\lambda^2 + 2\pi R}}{2\sqrt{2}} \qquad \text{[Equation 3]}$$

Here, d denotes the length of one side of the directional antenna 110, λ denotes the magnitude of wavelength of the radio waves radiated from the directional antenna 110, R denotes the lateral radius of curvature of the radio wave diffusion structure 120, and 7C denotes the ratio of a circle's circumference to its diameter.

Meanwhile, as mentioned above, the vehicular antenna device 100 may further include the dome structure 130 and the base plate 140.

The dome structure 130 may cover a space above the directional antenna 110, and the radio wave diffusion structure 120 may be installed on the inner surface of the dome structure 130. The dome structure 130 may be made of a material exhibiting a specific dielectric constant such as Polycarbonate (PC), Polyamide (PA), Polyacetal (POM), Poly Oxy Methylene (POM), Polyethylene terephthalate (PET), Acrylonitrile-Butadiene-Styrene (ABS) or a combination of two or more of them. In this case, a desirable dielectric constant of the dome structure 130 is 1~10 [F/m]. Additionally, the dome structure 130 may change in the size or thickness depending on the dielectric constant of the material.

The base plate 140 may be coupled to the lower surface of the directional antenna 110 to support the directional antenna 110. In this case, the base plate 140 may be coupled to the lower edge of the dome structure 130 to support the dome structure 130.

Figure 8:
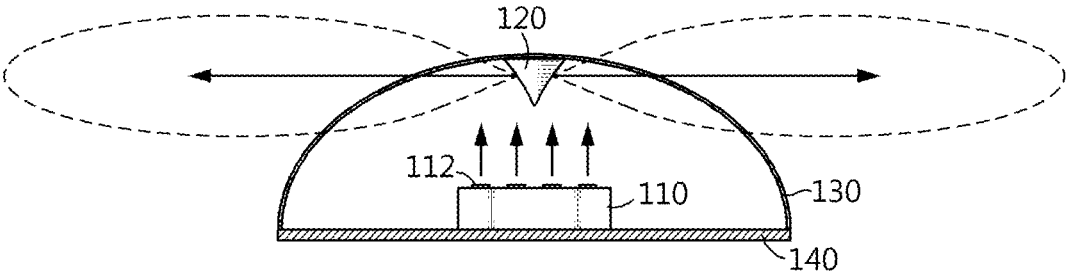
FIG. 8 is a diagram showing the principle of operation of a vehicular antenna device according to the present disclosure.

FIG. 8 is a diagram showing the principle of operation of the vehicular antenna device 100 according to the present disclosure.

As shown in FIG. 8, when the directional antenna 110 having high upward directionality starts to be powered, the directional antenna 110 radiates radio waves vertically upwards. The radiated radio waves are reflected in the lateral direction by the radio wave diffusion structure 120 installed vertically above and omnidirectionally spread out. As described above, the directional antenna 110 of the vehicular antenna device 100 only needs to radiate radio waves vertically upwards, and thus there is no need to perform beam tracking as opposed to the existing directional antennas. As a result, the vehicular antenna device 100 according to the present disclosure omits a component for beam tracking such as a phase shifter, thereby reducing the size of a vehicular antenna and simplifying the entire architecture of a vehicular communication system while ensuring the omnidirectionality required for a vehicular antenna.

Figure 9:
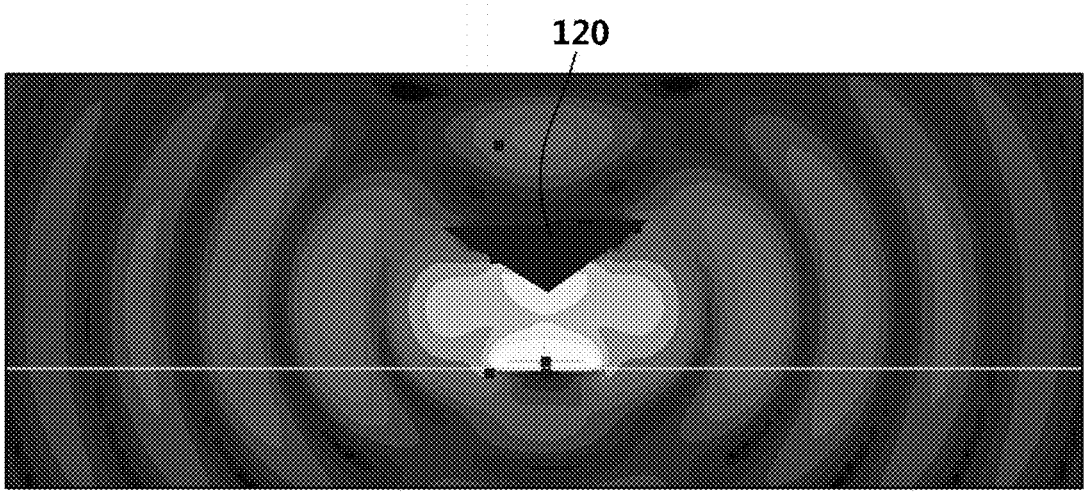
FIG. 9 is a graph showing the electric field distribution in 28 GHz frequency band of a vehicular antenna device according to the present disclosure.

FIG. 9 shows, in the form of a graph, the electric field distribution in 28 GHz frequency band of the vehicular antenna device 100 according to the present disclosure.

As shown in FIG. 9, it can be seen that radio waves radiated vertically upwards from the directional antenna 110 are reflected in the lateral direction by the radio wave diffusion structure 120 installed above the directional antenna 110, and omnidirectionally spread out.

Figure 10:
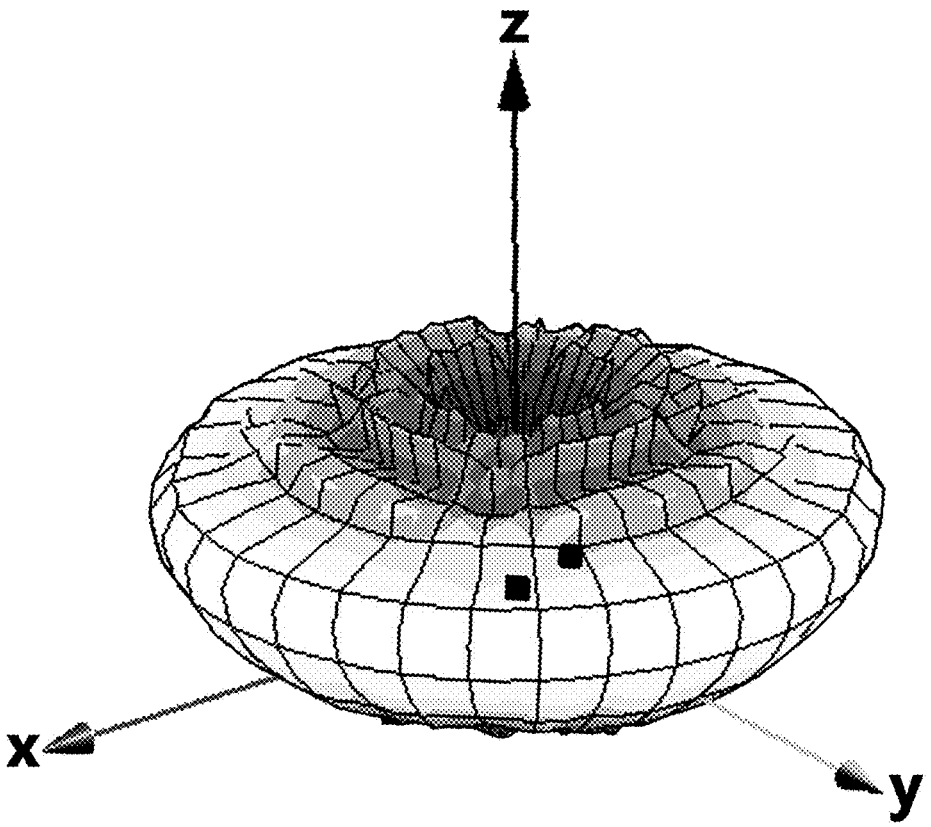
FIG. 10 is a graph showing a radiation pattern of a vehicular antenna device according to the present disclosure.

FIG. 10 shows, in the form of a graph, the radiation pattern of the vehicular antenna device 100 according to the present disclosure.

As shown in FIG. 10, it can be seen that the vehicular antenna device 100 according to the present disclosure shows an omnidirectionally uniform radiation pattern and can ensure the omnidirectionality required for a vehicular antenna when actually implementing the present disclosure.

Figure 11:
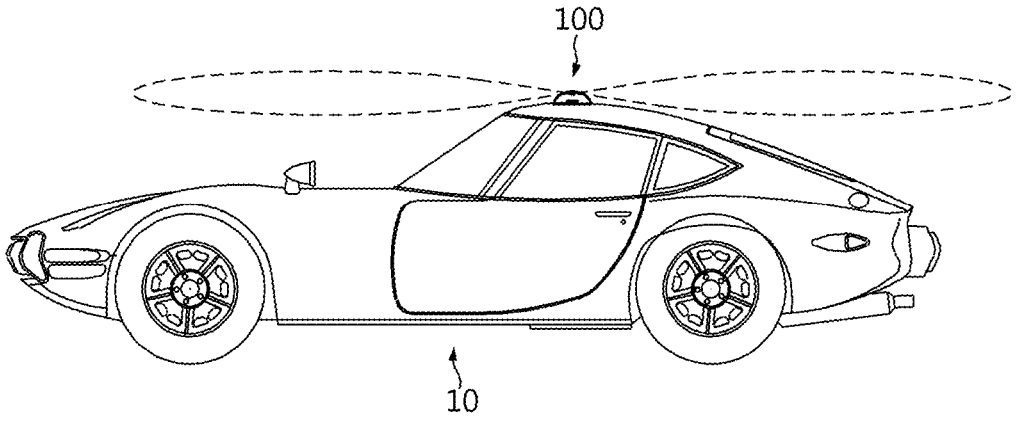
FIG. 11 is a diagram showing an example of application of a vehicular antenna device according to the present disclosure.

FIG. 11 shows an example of application of the vehicular antenna device 100 according to the present disclosure.

As shown in FIG. 11, the vehicular antenna device 100 may be installed on the roof of the vehicle 10. In this case, the base plate 140 of the vehicular antenna device 100 may be installed and fixed to the roof outer panel of the vehicle 10. To this end, the base plate 140 may include a coupling part (not shown) with the roof outer panel of the vehicle 10. In this case, the coupling part of the base plate 140 may be formed of a coupling protrusion that is inserted and fixed to an installation groove provided in the roof outer panel of the vehicle 10, an adhesive surface that is adhered to the roof outer panel of the vehicle 10 through an adhesive element, or a coupling groove that is attached to the roof outer panel of the vehicle 10 through insertion of a coupling element such as a screw.

As described above, when the vehicular antenna device 100 having the omnidirectionality of the radiation pattern is installed on the roof of the vehicle 10 to radiate radio waves and transmit and receive signals, it is possible to stably accomplish vehicular communication irrespective of the traveling direction of the vehicle 10.

As described above, according to the present disclosure, the omnidirectional vehicular antenna is implemented using the directional antenna capable of transmitting and receiving ultra high frequency band signals of 28 GHz or more, thereby applying 5G mobile communication technology to vehicular communication applications and improving the speed and quality of vehicular communication.

Additionally, without using a component for beam tracking, the radio wave diffusion structure is installed vertically above the directional antenna having high directionality to omnidirectionally spread out the radio waves radiated from the directional antenna traveling vertically upwards, thereby reducing the size of a vehicular antenna and simplifying the entire architecture of a vehicular communication system while ensuring the omnidirectionality required for a vehicular antenna.

Additionally, the vehicular antenna device is formed in a dome shape and installed in the roof outer panel of the vehicle, thereby preventing damage of the directional antenna and ensuring the antenna performance.

Further, it is obvious that the embodiments according to the present disclosure can solve these and other technical problems in the corresponding technical field as well as the related technical field.

The embodiments of the present disclosure have been hereinabove described in detail. However, those skilled in the art will clearly understand that a variety of modifications may be made to the embodiments within the technical scope of the present disclosure. Therefore, the disclosed embodiments should be considered in descriptive senses, not in limiting senses. That is, the scope of true technical aspects of the present disclosure is set forth in the appended claims, and it should be interpreted that the present disclosure covers all differences within the equivalent scope.

What is claimed is:

1. A vehicular antenna device comprising:

a directional antenna which radiates radio waves in a predetermined direction; and a radio wave diffusion structure installed vertically above the directional antenna to reflect radio waves radiated upwards from the directional antenna in a lateral direction for omnidirectional spreading, wherein the radio wave diffusion structure has a reciprocal cone shape with a base facing upwards and an apex facing the directional antenna, characterized in that:

the directional antenna is an array antenna formed in a square panel shape and having an upward directionality, the array antenna including a plurality of unit antenna elements arranged upwards, each of the plurality of unit antenna elements is a patch antenna, a lateral surface of the radio wave diffusion structure is inwardly curved at a constant radius of curvature R in vertical cross section, and a magnitude of the constant radius of curvature R satisfies Equation 1 when a magnitude of wavelength of the radiated radio waves is $\lambda$:

$$\pi\lambda < R < 20\lambda \quad \text{[Equation 1]}$$

where h is a vertical direction distance between an apex of the radio wave diffusion structure and the directional antenna satisfies Equation 2:

$$h = \frac{3d + \sqrt{\lambda^2 + 2\pi R}}{2\sqrt{2}} \quad \text{[Equation 2]}$$

wherein d denotes a length of one side of the directional antenna, $\lambda$ denotes a wavelength magnitude of radio waves radiated from the directional antenna, R denotes the constant radius of curvature of the radio wave diffusion structure, and $\pi$ denotes a ratio of a circle's circumference to its diameter.

2. The vehicular antenna device according to claim 1, further comprising:

a dome structure which covers a space above the directional antenna, and in which the radio wave diffusion structure is installed on an inner surface.

3. The vehicular antenna device according to claim 2, further comprising:

a base plate which is coupled to a lower surface of the directional antenna to support the directional antenna.

4. The vehicular antenna device according to claim 3, wherein the base plate is coupled to a lower edge of the dome structure to support the dome structure.

5. The vehicular antenna device according to claim 3, wherein the base plate includes a coupling part which is coupled with a roof outer panel of a vehicle.

* * * * *